United States Patent [19]

Daniels

[11] Patent Number: 4,841,640

[45] Date of Patent: Jun. 27, 1989

[54] HAND AND GUT GUARD

[76] Inventor: Charley H. Daniels, 213 Arthur Moore Dr., Green Cove Springs, Fla. 32043

[21] Appl. No.: 180,592

[22] Filed: Apr. 5, 1988

Related U.S. Application Data

[63] Continuation of Ser. No. 895,287, Aug. 11, 1986, abandoned.

[51] Int. Cl.[4] ..... B26B 29/02

[52] U.S. Cl. ..... 30/294; 30/123.5; 30/286; 17/21

[58] Field of Search ..... 30/123, 123.5, 143, 30/164, 286, 294, 295, 312, 313; 17/21; 7/164

[56] References Cited

U.S. PATENT DOCUMENTS

| | | | |
|---|---|---|---|
| 755,172 | 3/1904 | Ryan | 30/123 X |
| 1,299,084 | 4/1919 | Wilson | 30/286 |
| 2,198,814 | 4/1940 | Hart | 30/286 |
| 4,198,751 | 4/1980 | Egbert | 30/286 |
| 4,290,201 | 9/1981 | Goodwin | 30/294 |
| 4,601,102 | 7/1986 | Phillips | 30/286 X |

FOREIGN PATENT DOCUMENTS

| | | | |
|---|---|---|---|
| 1215289 | 11/1959 | France | 273/426 |

*Primary Examiner*—Frank T. Yost
*Assistant Examiner*—Michael D. Folkerts
*Attorney, Agent, or Firm*—Arthur G. Yeager

[57] ABSTRACT

A guard made for hunters to aid them in field dressing animals in woods or cutting them in camp, with no fear of cutting hand or animals gut. He uses this guard with his own hunting knife making the job quick and easy. The guard is also a whistle, in case of an emergency the hunter can signal hunting partner or near by hunters. It can easily be carried in hunters pocket, it's only six and three quarters inchs long, and it'open from end to end for easy cleaning.

2 Claims, 2 Drawing Sheets

HAND AND GUT GUARD

This is a continuation-in-part of co-pending application Ser. No. 06/895,287 filed on Aug. 11, 1986 now abandoned.

This guard is made for hunters to aid them in field dressing animals in woods, or gutting them in camp, with no fear of cutting hand or gut. He uses this guard along with his hunting knife. You can gut animals as small as a squirrel or as large as a moose with ease. It can also be used as an emergency whistle to signal hunting partner or near by hunters.

Figure 1:
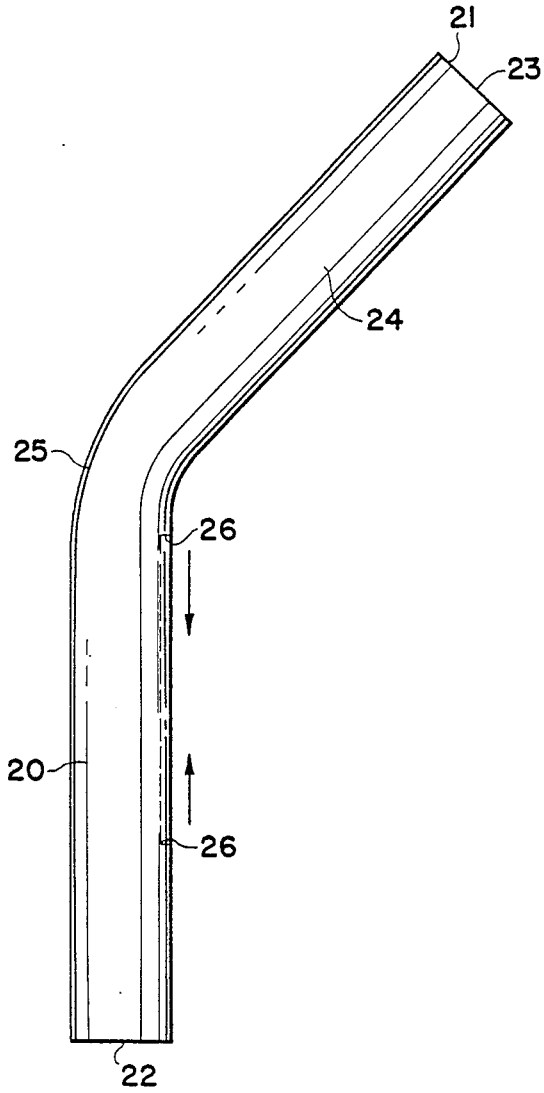

The guard is made of round rigid plastic. FIG. 1 drawing is actual size of Hand and Gut Guard seven inches long, outside diameter is five eights inches 20, inside diameter seven sixteenth inches23, three and one half inches from top 21 there is a forty five degree bend to form handle 25. One and one quarter inch from bottom end 22, there is a groove one eighth of an inch wide 26, it goes up two inches to top 26.

Figure 2:
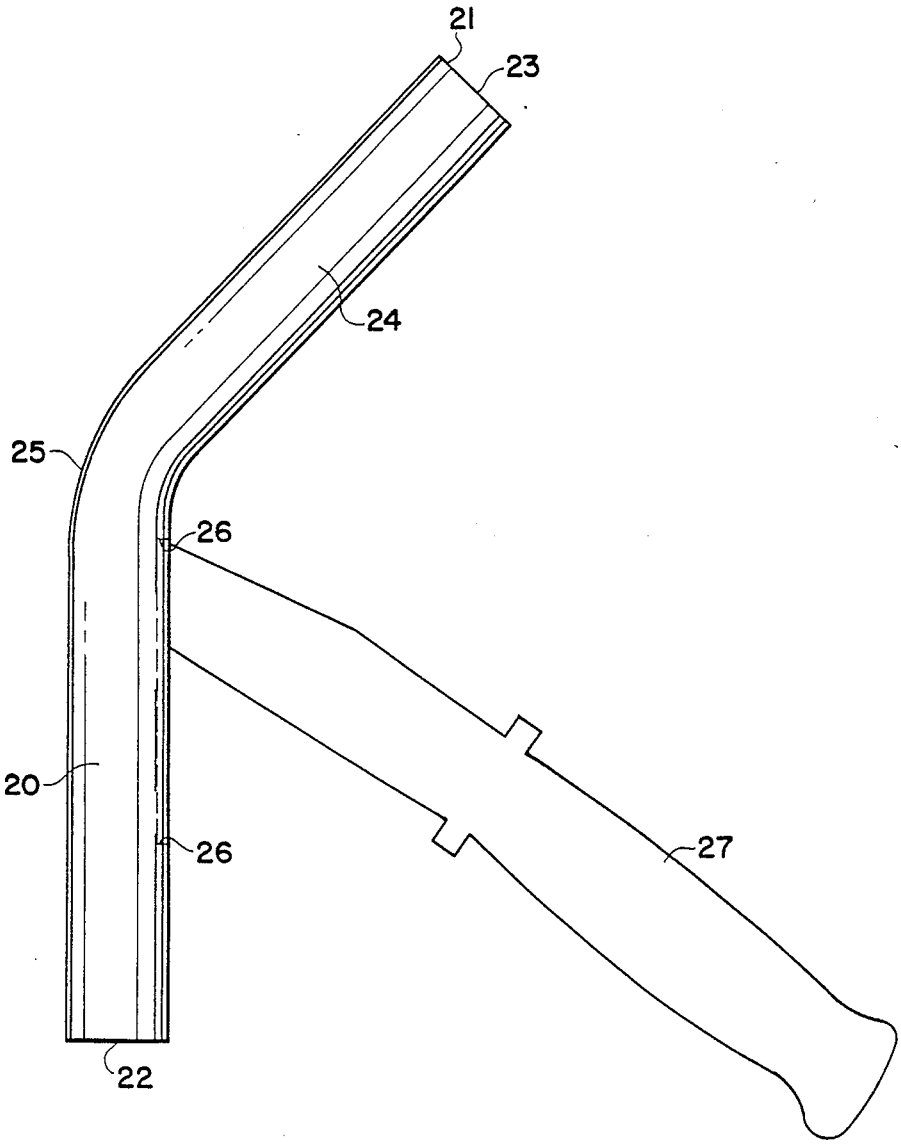

FIG. 2 shows hunters knife 27 blade in groove 26. To gut animal make a cut between back legs approximately one inch long, with one hand on handle 24, insert bottom end 22 into one inch cut, then put knife 27 blade into top groove 26, with a little outward pressure put on inside of animals stomach, simply slide guard down to rib cage.

Figure 3:
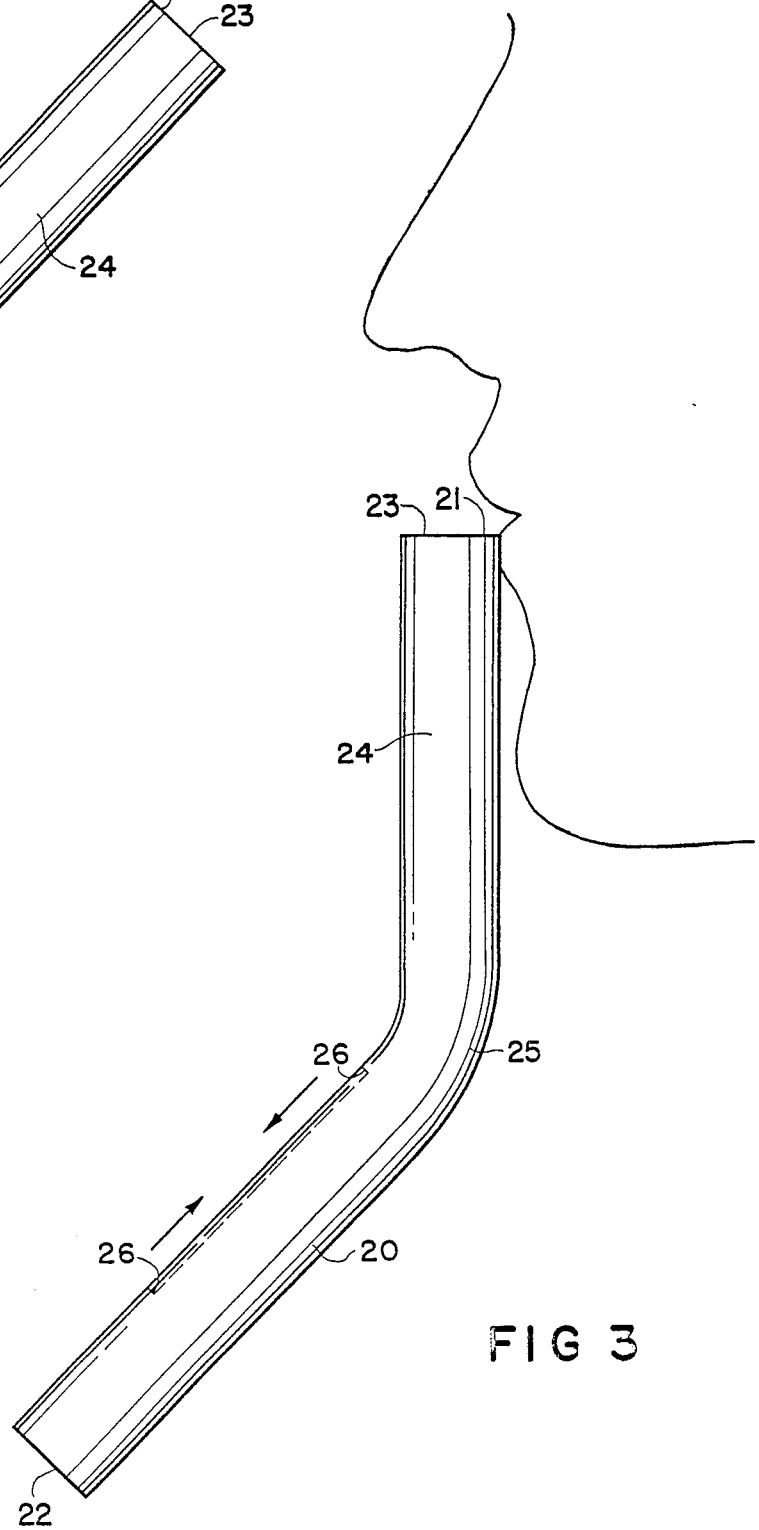

FIG. 3 shows how to use the emergency whistle. Hold whistle so the palm of your hand will cover two inch groove, 26—26, cover bottom 22 with finger of other hand, put top 21 to lower lip, blow air down into inside 23, this will create a loud whistling noise.

The Hand and Gut Guard is seven inches long, but after the forty five degree bend to form handle, it is six and three quarter inches long making it easy to carry in the hunters pocket.

I claim:

1. A knife guard for use in skinning animals comprising a rigid unitary tubular pipe section bent in the middle to form two linear portions joined to each other through a bent portion such that the included angle between the said linear portions is about 135°, and a lengthwise slit through the wall in one of said linear portions from adjacent said bent portion to adjacent the end of said portion and facing said included angle, each said linear portion having a longitudinal axis lying in substantially the same plane as that including said slit.

2. A knife guard for use in skinning animals comprising a rigid tubular section bent in the middle to form two angularly disposed linear portions having respective longitudinal axes which lie in a single plane and intersect at an angle of about 135°, a lengthwise slit piercing the wall of one of said portions and extending from adjacent said middle to adjacent the end of said one portion, and lying generally in said plane and facing said angle, said slit adapted to receive the point of the blade of a skinning knife adjacent said middle with the cutting edge of said blade facing said end.

* * * * *